US012612280B2

(12) United States Patent
Jansen et al.

(10) Patent No.: US 12,612,280 B2
(45) Date of Patent: Apr. 28, 2026

(54) METHOD AND DEVICE FOR POSITIONALLY ACCURATE PROCESSING OF A MATERIAL WEB

(71) Applicant: OPTIMA life science GmbH, Schwäbisch Hall (DE)

(72) Inventors: Johannes Jansen, Michelfeld (DE); Norbert Dylla, Vellberg (DE)

(73) Assignee: OPTIMA life science GmbH, Schwäbisch Hall (DE)

( * ) Notice: Subject to any disclaimer, the term of this patent is extended or adjusted under 35 U.S.C. 154(b) by 238 days.

(21) Appl. No.: 18/224,366

(22) Filed: Jul. 20, 2023

(65) Prior Publication Data

US 2024/0025687 A1 Jan. 25, 2024

(30) Foreign Application Priority Data

Jul. 22, 2022 (DE) ..... 102022207518.8

(51) Int. Cl.
*B65H 23/18* (2006.01)
*B65H 23/188* (2006.01)

(52) U.S. Cl.
CPC ..... *B65H 23/1882* (2013.01)

(58) Field of Classification Search
CPC ..... B65H 23/1882; B65H 2801/72; H01M 8/1004; H01M 8/0297; B32B 38/18; B32B 38/185
USPC ..... 270/52.02
See application file for complete search history.

(56) References Cited

U.S. PATENT DOCUMENTS 4,839,674 A * 6/1989 Hanagata ..... B41J 11/46 271/227
5,979,732 A * 11/1999 Crowley ..... G03G 15/6517 226/111
6,935,998 B2 * 8/2005 Silvestre ..... B65H 43/00 493/405
7,195,690 B2 * 3/2007 Mekala ..... H01M 8/00 156/298

(Continued)

FOREIGN PATENT DOCUMENTS

DE 10 2016 000 974 A1 8/2017
DE 10 2021 123 475 A1 3/2023
KR 102322980 B1 11/2021

OTHER PUBLICATIONS

European Search Report dated Jan. 15, 2024 in connection with European Patent Application No. 23184616.3.

*Primary Examiner* — Leslie A Nicholson, III
(74) *Attorney, Agent, or Firm* — Blank Rome

(57) ABSTRACT

The invention relates to a method and an apparatus for positionally accurate processing of a material web in a web-processing process for the series production of products, in particular for producing membrane assemblies, wherein a shaped element (2) is introduced into the material web (1) or a shaped element (2) is applied to the material web (1), wherein multiple reference marks (3) per product are created when the shaped element (2) is being introduced into or when the shaped element (2) is being applied to the material web, and, in a subsequent process step for positionally accurate processing of the material web (1) relative to the shaped element (2) of a product, the position of at least one of the multiple reference marks (3) of this product and/or at least one of the multiple reference marks (3) of a following and/or a preceding product is detected.

10 Claims, 4 Drawing Sheets

(56) References Cited

U.S. PATENT DOCUMENTS

| | | | | |
|---|---|---|---|---|
| 7,219,606 | B2 * | 5/2007 | Mindrup | B65H 23/048 101/248 |
| 8,157,776 | B2 * | 4/2012 | Carlen | A61F 13/15772 604/385.01 |
| 8,288,059 | B2 * | 10/2012 | Pierpont | B32B 37/203 429/479 |
| 2008/0145712 | A1 | 6/2008 | Pierpont et al. | |
| 2024/0372117 | A1 * | 11/2024 | Leeratanaphanit | H01M 8/0273 |

* cited by examiner

METHOD AND DEVICE FOR POSITIONALLY ACCURATE PROCESSING OF A MATERIAL WEB

CROSS-REFERENCE TO RELATED APPLICATIONS

The present application claims priority to German Patent Application No. 102022207518.8, filed on Jul. 22, 2022, the entirety of which is incorporated herein by reference.

FIELD OF APPLICATION AND PRIOR ART

The invention relates to a method and an apparatus for positionally accurate processing of a material web in a web-processing process.

Web-processing process denotes a process in which a material web runs through one or more successive process steps. In this case, in each process step the material web undergoes changes, in particular but not exclusively parts of the material web are cut out, other material webs or blanks are added, and/or parts of the material web are drawn off.

For example, it is known to produce a membrane electrode assembly (MEA) or parts of one for a fuel cell or an electrolyser in a web-processing process. The MEA comprises a catalyst-coated membrane (CCM for short), on one side or both sides of which edge reinforcements or frames (also referred to as rim) of inexpensive and relatively resistant material are provided. In this case, it is known to provide material webs for the frames, wherein cutouts for windows are made in the material webs and the CCM is connected to the material webs in such a way that an active region is disposed in the windows and an edge of the active region of the CCM is covered by regions surrounding the windows. As an alternative or in addition to windows, in other embodiments further or other cutouts can be made in material webs for frames or other layers and form channel structures or openings for connections in a later material composite. In addition or as an alternative, in some configurations further elements, such as gas diffusion layers (GDL), in the form of blanks can be placed positionally accurately in relation to the windows.

Membrane electrode assemblies for fuel cells or electrolysers and other laminates comprising a membrane and further layers, for example for a humidifier, are denoted membrane assemblies in connection with the application.

For certain process steps, in particular during the production of a membrane assembly, it is necessary to carry out this process step in a defined position relative to a shaped element present in or on the material web, for example a window cutout present in the material web, and/or relative to a shaped element present on the material web, such as a blank deposited on the material web or an impression. These process steps include, for example but not exclusively, depositing a blank on the material web, connecting a material web to a second material web, or creating punched contours.

In order to carry out a process step in relation to a shaped element which is present, it is known to detect a position of the shaped element and to align a process station or parts of a process station relative to the material web in accordance with a detected position of the shaped elements.

Detecting the position of the shaped elements, however, sometimes is not possible or is possible only to a limited extent, for example when the shaped elements are concealed by product components or parts of a process station and thus cannot be detected directly.

For example, during the production of an MEA in a web-processing process, blanks are positioned on window cutouts, wherein subsequent punching operations are to be carried out in relation to these window cutouts. In the process, both the blanks deposited on the window cutouts and parts of the process station for carrying out the punching operation conceal the window cutouts.

KR102322980 B1 discloses providing a cutout on a punching station in order to be able to dispose a sensor system such that a position of a shaped element which is present on the material web and is not concealed by the material web itself can be detected in order to carry out a punching process with positional accuracy relative to the recorded position of the shaped element.

Problem and Solution

The object of the invention is to provide a method and an apparatus for positionally accurate processing of a material web in a web-processing process relative to a shaped element provided on or in the material web.

This object is achieved by the subject matter having the features of Claims 1 and 7. Advantageous embodiments emerge from the dependent claims.

According to a first aspect, what is provided is a method for positionally accurate processing of a material web in a web-processing process for the series production of products, in particular for producing membrane assemblies, wherein for each product a shaped element is introduced into the material web or a shaped element is applied to the material web, wherein multiple reference marks per product are created when the shaped element is being introduced into or when the shaped element is being applied to the material web, and wherein, in a subsequent process step for positionally accurate processing of the material web relative to the shaped element of a product, the position of at least one of the reference marks of this product and/or at least one of the multiple reference marks of a following and/or a preceding product is detected.

According to a second aspect, what is provided is an apparatus for positionally accurate processing of a material web in a web-processing process for the series production of products, in particular for producing membrane assemblies, comprising a shaped-element station, wherein the shaped-element station is designed to introduce, for each product, a shaped element into the material web or to apply a shaped element to the material web, wherein the apparatus is designed to create multiple reference marks per product when the shaped element is being introduced into or when the shaped element is being applied to the material web, wherein, for subsequent positionally accurate processing of the material web relative to the shaped element of a product, the position of at least one of the reference marks of this product and/or at least one of the multiple reference marks of a following and/or a preceding product can be detected.

According to a third aspect, what is provided is a web-processing plant for positionally accurate processing of a material web in a web-processing process for the series production of products, in particular for producing membrane assemblies, comprising an apparatus having a shaped-element station, wherein the shaped-element station is designed to introduce, for each product, a shaped element into the material web or to apply a shaped element to the material web and to create multiple reference marks per product when the shaped element is being introduced into or when the shaped element is being applied to the material web, and a process station, downstream of the shaped-element station, for processing the material web, wherein the process station has a sensor system, in particular an optical sensor system comprising a camera, by means of which, for positionally accurate processing of the material web relative to the shaped element of a product, the position of at least one of the reference marks of this product and/or at least one of the multiple reference marks of a following and/or a preceding product can be detected at the process station.

In connection with the application, the term "a" is used merely as a specific term and not as a numerical word. In particular, in some embodiments, more than one shaped element is introduced into or onto the material web per product. In some embodiments, the web-processing plant also comprises more than one process station.

Similarly, the terms "first", "second" etc. are used merely for making a distinction between elements and do not indicate a sequence.

By creating the reference marks when the shaped element is being introduced or applied, the reference marks and the shaped element have a defined geometric relationship, which stays the same upon further processing of the material web. Therefore, the reference marks can be used for subsequent process steps in order to carry them out with positional accuracy relative to the shaped element provided on or in the material web.

If two or more subsequent process steps are intended, in some embodiments it is provided that these different reference marks are detected for positionally accurate processing, wherein in each case one or more reference marks which are not concealed by product parts or by parts of a process station when the respective process step is being carried out are detected for the positioning.

By means of the reference marks, it is possible to position the material web relative to a process station and/or relative to another reference point for positionally accurate processing of the material web relative to the shaped element without detecting the position of the shaped element itself. The selection of the detected reference mark(s) is in this respect individually possible for each process station, wherein in each case one or more reference marks which are not concealed by product parts or by parts of the process station when the respective process step is being carried out are detected for the positioning.

The positioning at the process station is therefore possible irrespective of a position and/or size of the associated shaped element and/or a product size of a final or intermediate product to be provided by the processing of the material web. This is particularly advantageous if multiple process stations with different properties are provided in a plant.

In this respect, it is conceivable, for the positioning relative to the shaped element of a product, to detect one or more reference marks which were introduced with the shaped element of a following or preceding product. This is advantageous in particular if products with different product sizes are produced in a plant. In this respect, by suitably introducing the reference marks and suitably selecting the reference marks that are to be detected at the process stations, it is possible to change over between the product sizes without it being necessary to reposition a sensor system for detecting the reference marks.

In connection with the application, reference mark denotes any marking on a material web which can be detected by means of a sensor system. In advantageous embodiments, optically detectable reference marks, such as colour markings, punched markings, embossed markings or the like, are provided. The shape of the reference marks can be suitably selected by those skilled in the art depending on a material web and/or a shaped-element station for introducing or applying the shaped element.

In advantageous embodiments, it is provided that the position of the reference mark is detected by means of an optical sensor system, in particular a sensor system comprising a camera. Optical sensor systems are distinguished by high robustness, high accuracy and high flexibility.

Depending on the shape of the reference mark and/or a system used for detecting the reference mark, in this case exactly one reference mark per shaped element may be enough to detect a position and orientation of this shaped element in a plane on the basis of the reference mark. If only a positional deviation is to be detected for positionally accurate processing, in one embodiment the position of exactly one reference mark is detected for an alignment of the material web and/or of the process station. By detecting the position of a reference mark, it is possible to ascertain a positional deviation in the transport direction of the web and transversely thereto. In other embodiments, two or more reference marks are detected for the positionally accurate processing of the material web relative to this shaped element. By detecting the positions of two reference marks, it is additionally possible to ascertain an angular deviation of the web in relation to the machine longitudinal axis and other deviations.

In one embodiment, it is provided that the shaped element is introduced into the material web or applied to the material web by means of a tool, wherein the reference marks are created by means of this tool when the shaped element is being introduced or when the shaped element is being applied.

In connection with the application, tool denotes any operating means which makes it possible to create the shaped elements in or on the material web. In one embodiment, the tool is in the form of a punching tool, for example a punching die of a lift punch or a punching roller of a rotary punch, wherein the punching tool has additional contours for creating the reference marks. In this case, in one embodiment the contours are in the form of punched contours. In other embodiments, the contours are in the form of embossed contours. In yet another embodiment, the tool is a tool for additively processing the material web and/or a printing tool for printing the material web. In this respect, during the additive processing or the printing for applying the shaped element, at the same time a reference mark is additively applied to the material web or printed onto the material web, respectively.

In some embodiments, it is provided that the reference marks are created in or on an oversize region of the material web. Oversize region denotes a region of the material web which is not part of a product to be created in the web-processing process. By creating the reference marks in an oversize region, it is ensured that introduced reference marks are not present on a created product. Depending on the properties of the reference marks, however, in other embodiments they may also form elements of the finished product. For example, it is conceivable to make use of reference marks in the form of embossed formations for subsequent fixing of a material web to a further material web. In some embodiments, it is provided that the reference mark is created in an edge of the material web. The arrangement on an edge of the material web, independently of an arrangement in an oversize region, is advantageous for an arrangement of a sensor system and the ability of the sensor system to perform detection.

In a web-processing process, shaped elements are introduced or applied in a continuous sequence at constant intervals. By creating the reference marks when the shaped element is being introduced or applied, a continuous sequence of reference marks corresponding to a sequence of the shaped elements is created in or on the material web.

In one embodiment, it is provided in this respect for a constant sequence of equidistant reference marks to be created. The constant sequence has the advantage that the reference marks can also be used for other tasks, such as speed monitoring. The interval between the reference marks is selected here in such a way that the interval between the shaped elements is an integral multiple of the interval between the reference marks.

As an alternative or in addition, in one embodiment it is provided that two sequences of reference marks are created in the material web along two tracks. Depending on the shape, only two or more than two tracks can be provided. In this case, each process station can selectively use one or more reference marks of a track or more than one track. This makes it possible for the detection of the positioning of the shaped element for the subsequent process step highly precise.

In one embodiment, in all process steps following the creation of the reference marks, the reference marks are used exclusively for positioning of the material web relative to a process station and/or for positioning of further material webs and/or shaped elements that are to be connected to the material web. In other embodiments, the reference marks are used only in one or more process steps, while in other process steps other elements, for example the shaped element introduced with the reference marks and/or additional shaped elements, are used.

In one embodiment, in a process step following the creation of the reference marks and/or in a process station downstream of the shaped-element station, the position of at least one reference mark relative to a stationary reference point on the process station and/or relative to an adjustably mounted element of the process station, for example a positionally adjustable tool, is detected.

In one embodiment, it is alternatively or additionally provided that, in a process step following the creation of the reference marks, for each product an additional shaped element is introduced into the material web or an additional shaped element is applied to the material web, wherein, in a further process step, the position of the additional shaped element and the position of at least one reference mark are detected. The further process step is used here in one embodiment as control step for checking the correct positioning of the additional shaped element on the material web. In one embodiment, the additional shaped element is a blank deposited on the material web. In other embodiments, the additional shaped element is an impression applied to the material web or a cutout made in the material web.

In a further embodiment, it is alternatively or additionally provided that, in a process step following the creation of the reference marks, the material web (also referred to as first material web) is laminated with a second material web, wherein shaped elements and reference marks are also introduced into the second material web, wherein the position of at least one reference mark of the (first) material web relative to the position of at least one reference mark of the second material web is detected. A detected relative position of the reference marks can be analysed here in order to check, and possibly correct, the phase position of the shaped elements of the second material web relative to those of the first material web. This is advantageous in particular when the shaped element of the second material web is to positioned congruently with and/or in a defined position relative to the shaped element of the first material web.

BRIEF DESCRIPTION OF THE DRAWINGS

Further advantages and aspects of the invention will become apparent from the claims and from the description of exemplary embodiments of the invention, which are explained below on the basis of the figures. In the figures:

DETAILED DESCRIPTION OF THE EXEMPLARY EMBODIMENTS

Figure 1:
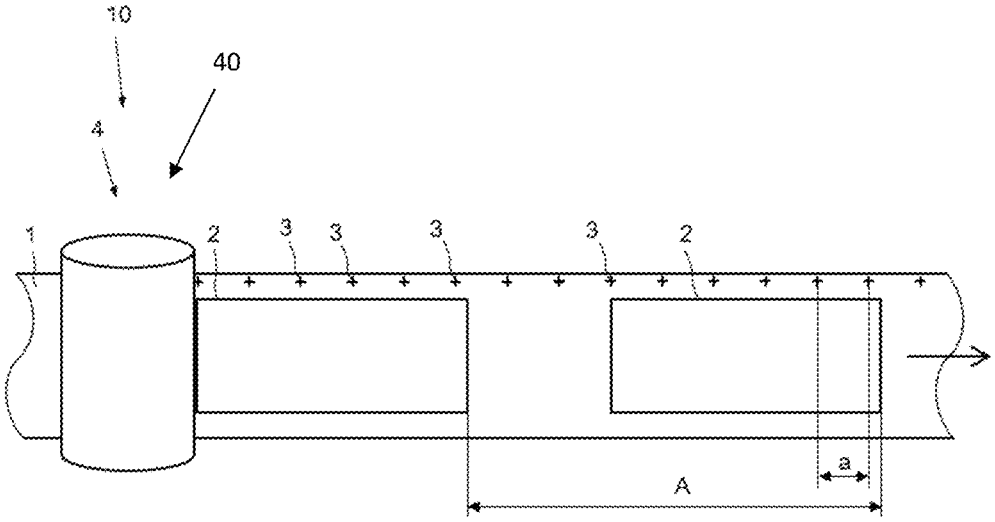
FIG. 1 shows a plan view of an apparatus for positionally accurate processing of a material web in a web-processing process.

FIG. 1 shows a plan view of an apparatus 10 for positionally accurate processing of a material web 1 in a web-processing process for the series production of products. A transport direction of the material web 1 is illustrated schematically by an arrow here.

In the material web 1 illustrated, for each product to be produced a shaped element 2 in the form of a window cutout is introduced. The illustrated window cutouts are rectangular. In other embodiments, differently shaped window cutouts and/or other shaped elements 2 and/or more than one shaped element per product are provided.

The shaped elements 2 in the form of window cutouts are introduced at a shaped-element station 40. In the exemplary embodiment illustrated, the shaped elements 2 in the form of window cutouts are introduced by means of a schematically illustrated punching device comprising a punching cylinder 4. In other embodiments, a lift punch or a cutting device for introducing the window cutouts is provided. Depending on the shaped element, in other embodiments, instead of the punching device other tools for introducing or applying the shaped element are provided.

The apparatus 1 introduces reference marks 3 into the material web 1 when the shaped elements 2 are being introduced. In the process, in the exemplary embodiment illustrated in FIG. 1, a sequence of reference marks 3 is also introduced by means of the punching cylinder 4 for introducing the shaped elements 2.

In the exemplary embodiment illustrated, the reference marks 3 are introduced equidistantly at an interval a. An interval A between the shaped elements 2 is an integral multiple of the interval a between the reference marks 3. In the exemplary embodiment illustrated, it is eight times the interval a, but the layout is only by way of example.

Multiple reference marks 3, which are introduced into the material web 1 together with the shaped element 2 and therefore have a geometric relationship, defined by the punching cylinder 4, with the associated shaped element 2, are thus provided for each shaped element 2.

In the exemplary embodiment illustrated, eight reference marks 3, all of which have a defined geometric relationship with the associated shaped element 2, are provided for each shaped element 2.

As described below on the basis of FIGS. 2 and 3, the respective position of at least one reference mark 3 can be detected for subsequent positionally accurate processing of the material web 1 relative to the shaped elements 2.

Figure 2:
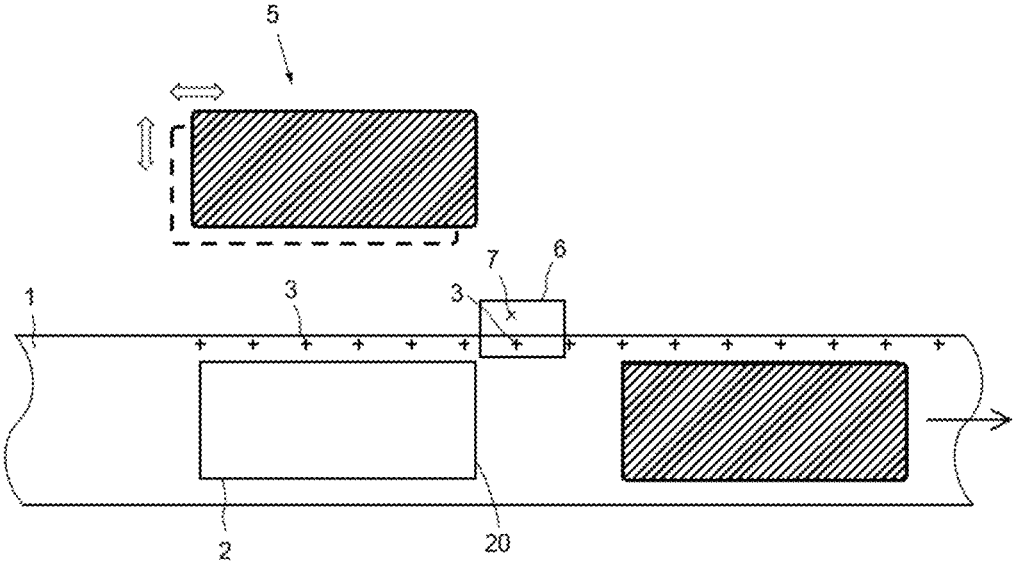
FIG. 2 shows a plan view of the material web according to FIG. 1 during a first process step in a web-processing process.

FIG. 2 schematically shows a plan view of the material web 1 according to FIG. 1 during a first process step for depositing blanks 5 onto the shaped elements 2 in the form of window cutouts.

In this case, in the exemplary embodiment illustrated, a position of a reference mark 3 that is upstream of a leading edge 20 of a shaped element 2 that is to be covered with the blank 5 is detected by means of a sensor device 6. This reference mark 3 has a defined geometric relationship with the associated shaped element 2. In the exemplary embodiment illustrated, the position of exactly one reference mark 3 relative to a stationary reference point 7 is detected. On the basis of this detected position of the reference mark 3, it is possible—as schematically indicated by two double-headed arrows—to correct a position of the blank 5 in the longitudinal direction and/or in the transverse direction of the material web 1, in order to enable positionally accurate deposition of the blank 5 on the associated shaped element 2 in the form of a window cutout.

Figure 3:
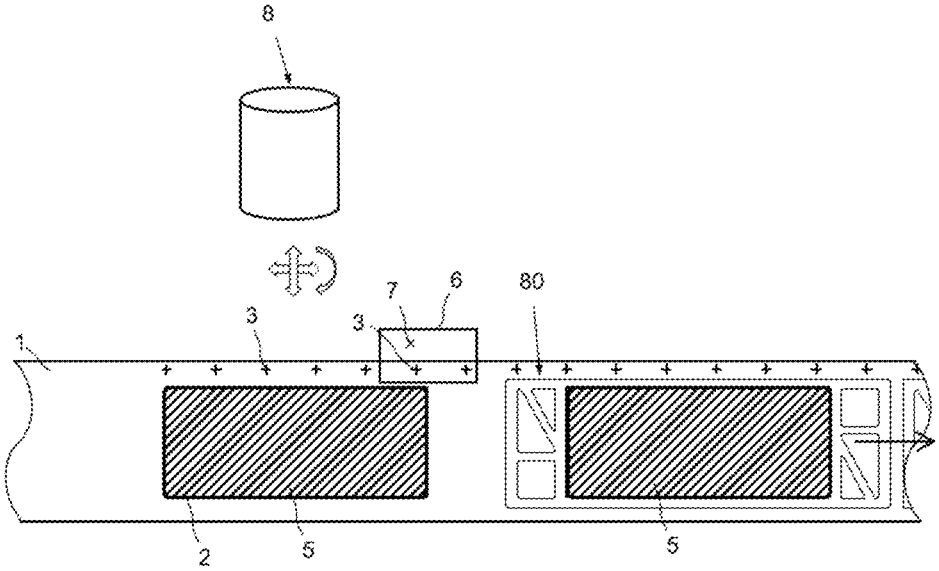
FIG. 3 shows a plan view of the material web according to FIG. 1 during a second process step in a web-processing process.

FIG. 3 schematically shows a plan view of the material web 1 according to FIG. 1 during a second process step for introducing punched contours 80 by means of a schematically illustrated punching roller 8.

In this case, in the exemplary embodiment illustrated, the positions of two reference marks 2, which are upstream and downstream of the leading edge 20 (cf. FIG. 2) of the shaped element 2 relevant for the processing, are detected by means of a further sensor device 6. The two reference marks 3 have a defined geometric relationship with this shaped element 2. In the exemplary embodiment illustrated, the positions of the two reference marks 3 relative to a stationary reference point 7 are detected. On the basis of the detected positions of the two reference marks 3, it is possible to correct a position and orientation of the punching rollers 8 in a plane parallel to the plane of the material web 1, in order to enable positionally accurate introduction of the punched contours 80 relative to the associated shaped element 2. The positionally accurate processing relative to the shaped element 2 is possible here by means of a sensor device 6 disposed above the material web 1, even though the shaped element is concealed by the blank 5.

In the case of the embodiment illustrated in FIG. 3, the positions of the two reference marks 3 are detected by means of a single sensor device 6. Instead of a single sensor device 6, in other embodiments multiple sensor devices 6 are provided, the signals from which are analysed together for positionally accurate processing of the material web.

As can be seen in FIG. 3, the reference marks 3 are disposed on an oversize region of the material web 1, that is to say in a region which is not part of the product to be produced. In the exemplary embodiment illustrated in FIGS. 1 to 3, the reference marks 3 are disposed on an edge of the material web.

The detection of exactly one or two reference marks 3 in the process steps according to FIGS. 2 and 3 is merely exemplary. In other embodiments, more than one reference mark 3 is detected during the process step according to FIG. 2 or only one reference mark 3 is detected during the process step according to FIG. 3. In yet other embodiments, further or alternative process steps are provided.

In a further embodiment, in addition to the sensor device 6 illustrated in FIG. 2 or FIG. 3, a further sensor device, not illustrated in the figures, is provided, which is designed to detect the position of the blank 5. In this respect, in one embodiment it is provided that the position of the blank 5 and the position of at least one reference mark 3 are detected between the process steps illustrated in FIGS. 2 and 3, in order to check the correct positioning of the blank 5 on the material web.

Figure 4:
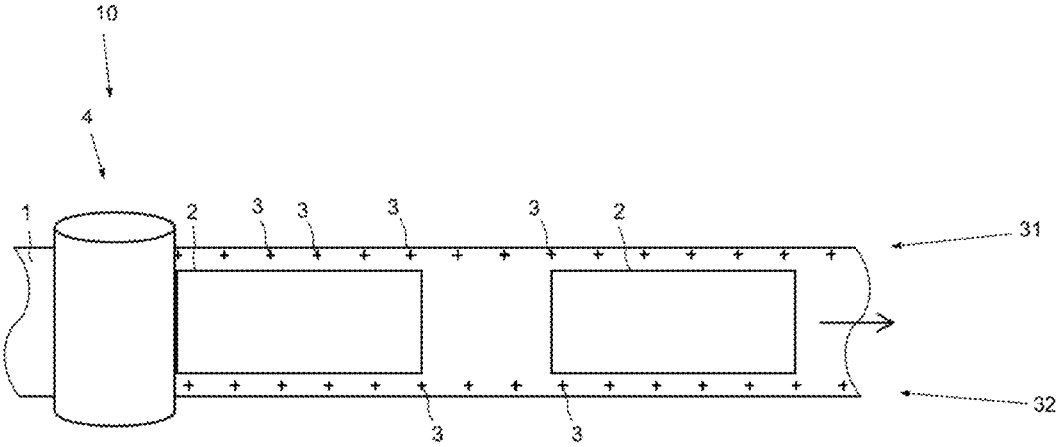
FIG. 4 shows a plan view of a second exemplary embodiment of an apparatus for positionally accurate processing of a material web in a web-processing process.

FIG. 4 shows a plan view of a second exemplary embodiment of an apparatus 10 for positionally accurate processing of a material web 1 in a web-processing process. The apparatus 10 according to FIG. 4 is similar to the apparatus 10 according to FIG. 1 and the same reference signs are used for elements that are the same or similar.

By contrast to the design according to FIG. 1, two sequences of reference marks 3 are provided on the material web 1 according to FIG. 4 along two tracks 31, 32. The reference marks 3 of the two tracks 31, 32 have the same interval in the exemplary embodiment illustrated. In other embodiments, the intervals between the reference marks 3 of the two tracks are different. In the exemplary embodiment illustrated, the tracks 31, 32 are offset in the transport direction, illustrated by an arrow, of the material web. In other embodiments, the reference marks of the two tracks 31, 32 are disposed at the same level in the transport direction.

To align the material web 1 and/or the process station for a process step, in this case the positions of at least one reference mark 3 from one of the two tracks can be detected.

Figure 5:
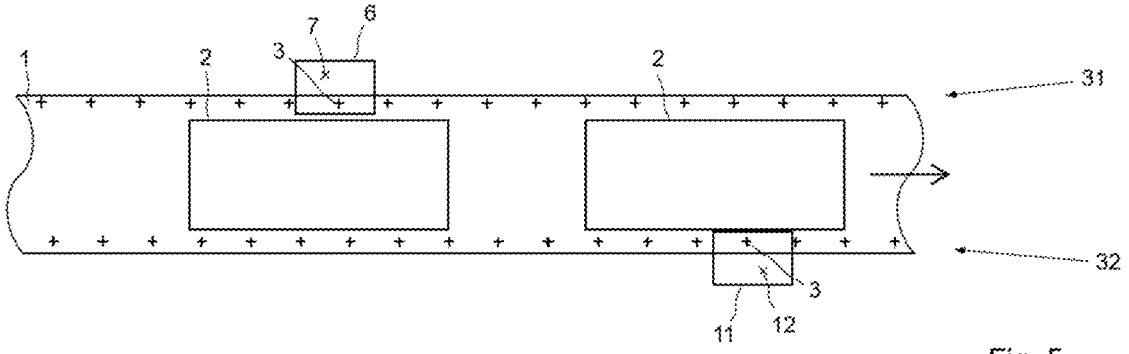
FIG. 5 shows a plan view of the material web according to FIG. 4 during a subsequent process step in a web-processing process.

As illustrated schematically in FIG. 5, in this case in some embodiments the positions of in each case at least one reference mark 3 of each of the two tracks 31, 32 are detected by means of a first sensor device 6 relative to a first reference point 7 and by means of a second sensor device 11 relative to a reference point 12.

In the exemplary embodiment illustrated in FIGS. 4 and 5, the tracks 31, 32 are disposed on opposite web edges. This makes it possible to maximize an interval between reference marks 3 of which the position is detected for alignment, with the result that high accuracy can be achieved for positionally accurate processing of the material web relative to the shaped element. In other embodiments (not illustrated), the tracks 31, 32 are disposed on a common edge of the material web.

Figure 6:
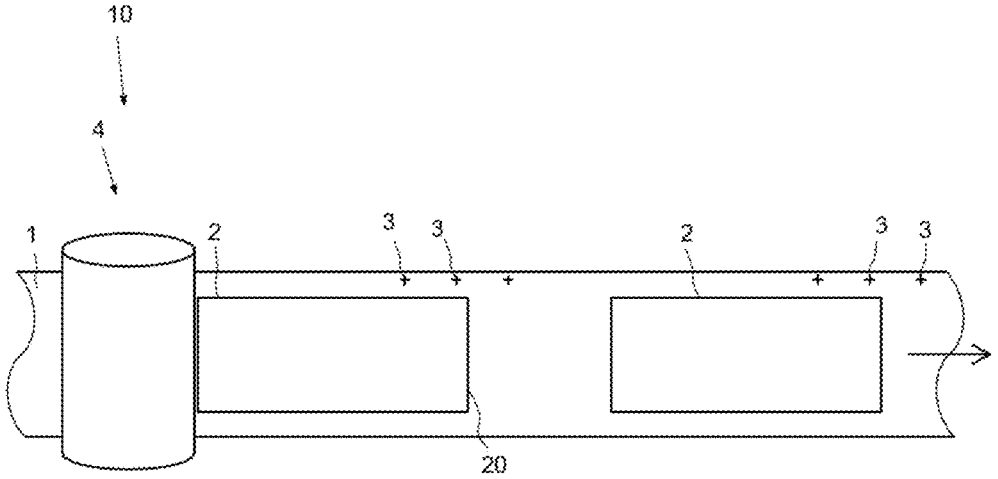
FIG. 6 shows a plan view of a third exemplary embodiment of an apparatus for positionally accurate processing of a material web in a web-processing process.

FIG. 6 shows a plan view of a third exemplary embodiment of an apparatus 10 for positionally accurate processing of a material web 1 in a web-processing process.

By contrast to the design according to FIG. 1, only three reference marks 3 per product are created on the material web 1 according to FIG. 6. A shaped element 2 is provided for each product, wherein the reference marks 3 in the exemplary embodiment illustrated are disposed in the region of a leading edge 20 of the shaped element 2. This arrangement is, however, merely exemplary.

The three reference marks 3 form a pattern, wherein the pattern repeats in a constant sequence in the longitudinal direction of the material web 1. An interval between the patterns is the same as an interval between the shaped elements in this case.

Figure 7:
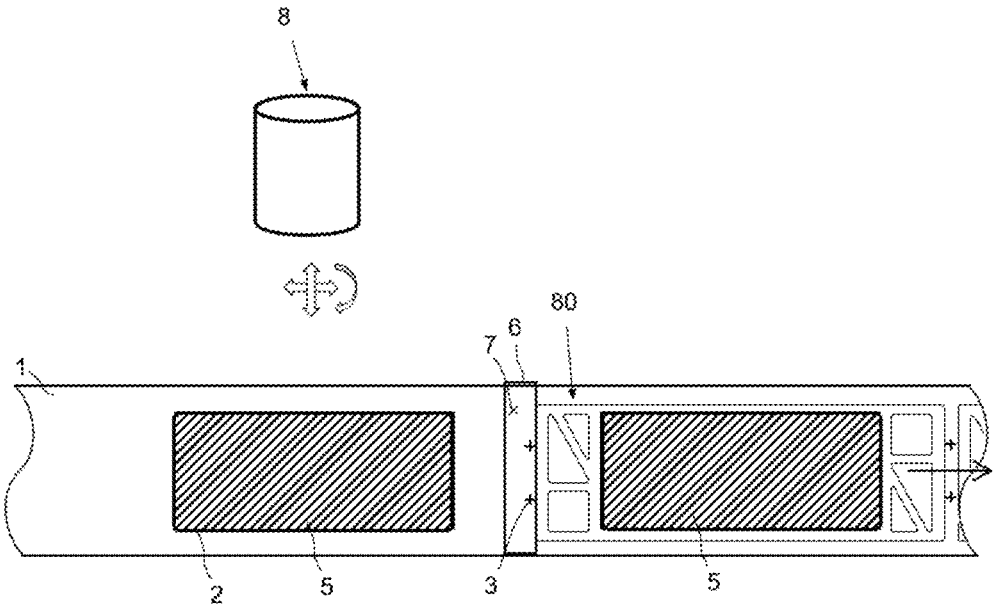
FIG. 7 shows a plan view of an alternatively processed material web during the second process step according to FIG. 3.

FIG. 7 shows a plan view of an alternatively processed material web 1 during the second process step according to FIG. 3.

By contrast to the design according to FIG. 3, only two reference marks 3 per product are provided on the material web 1 according to FIG. 7. In the exemplary embodiment illustrated in FIG. 6, the reference marks 3 are not introduced in the edge region but between the shaped elements 2 in an oversize region of the products that are to be created.

Figure 8:
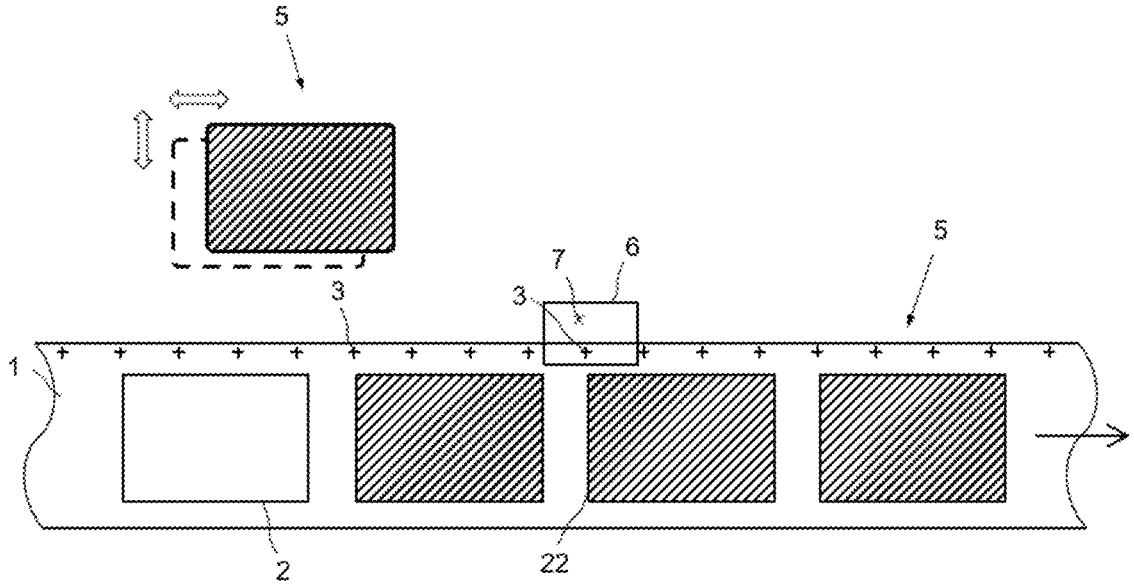
FIG. 8 shows a plan view of an alternatively processed material web during the first process step according to FIG. 2.

FIG. 8 schematically shows a plan view of a material web 1 during the first process step according to FIG. 2 for depositing blanks 5 onto the shaped elements 2 in the form of window cutouts. The products produced in the case of the exemplary embodiment according to FIG. 8 differ from the products produced in the case of the exemplary embodiment according to FIG. 2 in terms of a product size, wherein a shaped element 2 is provided for each product.

In this case, in the exemplary embodiment illustrated in FIG. 8, for positionally accurate deposition of the blank 5 on the shaped element 2 of a product, a position of a reference mark 3 that is downstream of a trailing edge 22 of an already covered shaped element 2 of a preceding product is detected by means of a sensor device 6.

The exemplary embodiments illustrated are merely exemplary and numerous modifications are conceivable.

The apparatuses illustrated and methods described can be used advantageously in particular during the production of a membrane assembly, such as an MEA.

In this case, in one embodiment the material web 1 is a material web of a frame material, into which shaped elements 2 in the form of window cutouts are introduced by means of a punching tool. The CCM is deposited onto the window cutouts. For exact positioning of a CCM relative to a window cutout, a position of at least one reference mark 3 is detected. On the basis of the detected position of the reference mark 3, the CCM and the material web 1 are aligned relative to one another and the CCM is deposited on the window cutout. After being transferred to the material web 1, the CCM conceals the window cutout, but not the reference marks 3.

Correct positioning of the CCM on the material web relative to the concealed window cutout can in this case be checked by detecting the position of at least one reference mark 3 and at the same time detecting the position of the CCM.

After the CCM has been transferred to the material web 1, cutouts which form channel structures or openings for connections in the finished MEA are made in the material web. For exact positioning of the cutouts relative to the window cutout concealed by the CCM, in one embodiment a position of at least one reference mark 3 is detected. On the basis of the detected position of the reference mark 3, a tool for making the cutouts and the material web 1 are aligned relative to one another. As an alternative, for this purpose the position of the CCM is detected, wherein the correct positioning of the CCM was checked preferably on the basis of the reference marks 3.

The invention claimed is:

1. A method for positionally accurate processing of a material web in a web-processing process for the series production of products, in particular for producing membrane assemblies, wherein:

for each product, a shaped element is introduced into the material web or a shaped element is applied to the material web, multiple reference marks per product are created when the shaped element is being introduced into or when the shaped element is being applied to the material web, a constant sequence of equidistant reference marks is created, an interval between the shaped elements is an integral multiple of an interval between the reference marks, and in a subsequent process step for positionally accurate processing of the material web relative to the shaped element of a product, the position of at least one of the multiple reference marks of this product and/or at least one of the multiple reference marks of a following and/or at least one of the multiple reference marks of a preceding product is detected, wherein in the subsequent process step for positionally accurate processing of the material web relative to the shaped element of the product, either: (i) exactly one reference mark is detected for an alignment of at least one of the material web and the process station, or (ii) two or more reference marks are detected to ascertain an angular deviation of the material web in relation to the machine longitudinal axis.

2. The method according to claim 1, wherein:

the shaped element is introduced into the material web or applied to the material web by means of the tool, and the reference marks are created by means of the tool when the shaped element is being introduced or when the shaped element is being applied.

3. The method according to claim 1, wherein the reference marks are created in or on an oversize region of the material web, in particular in or on an edge of the material web.

4. The method according to claim 1, wherein two sequences of reference marks are created in the material web along two tracks.

5. The method according to claim 1, wherein:

in a process step following the creation of the reference marks, for each product an additional shaped element is introduced into the material web or an additional shaped element is applied to the material web, and in a further process step, the position of the additional shaped element and of at least one reference mark are detected.

6. The method according to claim 1, wherein:

in a process step following the creation of the reference marks, the material web is laminated with a second material web, for each product a shaped element and at least one reference mark is introduced into the second material web before the laminating operation, and the position of at least one reference mark of the material web relative to the position of at least one reference mark of the second material web is detected.

7. An apparatus for positionally accurate processing of a material web in a web-processing process for the series production of products, in particular for producing membrane assemblies, comprising:

a shaped-element station, wherein the shaped-element station is designed to introduce, for each product, a shaped element into the material web or to apply a shaped element to the material web, wherein the shaping-element station is designed to create multiple reference marks per product when the shaped element is being introduced into or when the shaped element is being applied to the material web, wherein the shaped-element station, in particular a tool, is designed to create a constant sequence of equidistant reference marks on the material web, and wherein an interval between the shaped elements is an integral multiple of an interval between the reference marks and/or to create two sequences of reference marks along two tracks in the material web, and wherein, for subsequent positionally accurate processing of the material web relative to the shaped element of a product, the position of at least one of the multiple reference marks of this product and/or at least one of the multiple reference marks of a following and/or at least one of the multiple reference marks of a preceding product can be detected, wherein, for subsequent positionally accurate processing of the material web relative to the shaped element of the product, either (i) exactly one reference mark can be detected for an alignment of at least one of the material web and the process station, or (ii) two or more reference marks can be detected to ascertain an angular deviation of the material web in relation to the machine longitudinal axis.

8. The apparatus according to claim 7, wherein the tool is for introducing or applying the shaped element, wherein the tool is provided at the shaped-element station, and wherein the tool is designed to create the reference marks when the shaped element is being introduced into the material web or when the shaped element is being applied to the material web.

9. The apparatus according to claim 7, wherein the shaped-element station, in particular the tool, is designed to create the reference marks on an oversize region of the material web, in particular on an edge of the material web.

10. A web-processing plant comprising an apparatus according to claim 7 and a process station, downstream of the shaped-element station, for processing the material web, wherein the process station has a sensor system, in particular an optical sensor system comprising a camera, by means of which the position of at least one of the reference marks of this product and/or at least one of the multiple reference marks of a following and/or a preceding product can be detected at the process station.

* * * * *